US006370721B1

(12) United States Patent
Torres, Jr. et al.

(10) Patent No.: US 6,370,721 B1
(45) Date of Patent: Apr. 16, 2002

(54) VARIABLE SPEED PIG FOR PIPELINE APPLICATIONS

(75) Inventors: Carl R. Torres, Jr., Kingwood; Paul T. Manzak; Jack E. Miller, both of Houston, all of TX (US)

(73) Assignee: Tuboscope I/P, Inc., Houston, TX (US)

( * ) Notice: Subject to any disclaimer, the term of this patent is extended or adjusted under 35 U.S.C. 154(b) by 0 days.

(21) Appl. No.: 09/677,884

(22) Filed: Oct. 3, 2000

(51) Int. Cl.[7] ..... B08B 9/055
(52) U.S. Cl. ..... 15/104.061
(58) Field of Search ..... 15/3.5, 104.061, 15/104.063

(56) References Cited

U.S. PATENT DOCUMENTS 2,860,356 A * 11/1958 Matheny
3,495,546 A * 2/1970 Brown et al.
3,708,819 A * 1/1973 Breston
5,208,936 A * 5/1993 Campbell
6,070,285 A * 6/2000 Geppert
6,098,231 A * 8/2000 Smith et al.
6,190,090 B1 * 2/2001 Campbell et al.

* cited by examiner

*Primary Examiner*—Terrence R. Till
(74) *Attorney, Agent, or Firm*—Finnegan, Henderson, Farabow, Garrett & Dunner, LLP.

(57) ABSTRACT

A variable speed pig for movement within a pipeline having a plurality of venturi-shaped through passages extending longitudinally to permit fluid within the pipeline to bypass the pig. The size and shape of these passages may be varied to vary fluid pressure drop through the passages and the pig to correspondingly vary the speed of the pig passing through the pipeline.

13 Claims, 6 Drawing Sheets

50% TYPE

66% TYPE

75% TYPE

FULL CLOSED

FULL OPEN

FULL CLOSED

FULL OPEN

FLOW

VARIABLE SPEED PIG FOR PIPELINE APPLICATIONS

FIELD OF THE INVENTION

This invention relates to smart pipeline inspection gauges, commonly termed "smart pigs," used in the inspection of pipelines.

BACKGROUND OF THE INVENTION

Pigs are devices that are moved through a pipeline by the fluid pressure within the pipeline to provide information regarding the condition of the pipeline. This can vary between simple tasks, such as cleaning pipelines to more sophisticated determinations such as measurement of metal loss of the pipe due to corrosion, cracks, deformation and the like. Pigs that perform these tasks are called "smart pigs". Smart pigs may consist of various modules, in which one of the modules performs the function of propelling the smart pig through the pipeline. With respect to determining metal loss in the pipe, the industry standard is to use the technique of Magnetic Flux Leakage (MFL). With this technique, the speed of the pig cannot exceed 7 mph or otherwise the quality of the MFL measurement is degraded. For this purpose, it is customary to reduce the volumetric throughput of the pipeline to obtain the proper pig speed and thus achieve the desired high quality of inspection. This is undesirable because it also results in reduced production. For example, in the case of gas pipelines, the volumetric throughput can typically reach speeds up to 25 mph. To reduce the adverse affect on production and to maintain integrity of the MFL measurements, it is necessary to otherwise control the speed of the pig passing through the pipeline and maintain production through the pipeline. In gas pipelines it is known to do this by varying the gas bypassing through the pig. Conventional devices for performing this function are shown in U.S. Pat. No. 5,208,936, issued May 11, 1993. Although prior art mechanisms, such as the one disclosed in the aforementioned patent, are used for this purpose, their use is not practical at the high gas flow rates encountered in gas pipelines, because they exhibit a narrow controllable pressure drop range that limits the product flow conditions with which these mechanisms may be effectively used.

SUMMARY OF THE INVENTION

It is accordingly an object of the present invention to provide a more efficient mechanism for allowing flow to bypass through the smart pig at high velocities occurring in present day gas pipelines, while effectively and accurately controlling the speed of the pig at the lower limits required for high quality MFL inspection. This is achieved by the use of a plurality of venturi-shaped through passages for controlling the flow of fluid through the pig. It has been determined that by the use of venturi-shaped passages for this purpose turbulence, loss of fluid energy, and momentum are avoided and results in recovery of static pressure which does not occur with prior art devices. When in the full-open position the venturi-shaped passages provide maximum reduction in flow loss. By providing a more efficient mechanism for this purpose, the allowable flow range of the pig may be increased. This efficiency is necessary when the mechanism is in the maximum bypass position to operate the pig at low speeds relative to the gas flow rate through the pipeline.

The bypass of fluid, including gas, through the pig creates a pressure drop or pressure differential. This pressure differential, as is well known, propels the pig through the pipeline. Additional factors that affect the movement of the pig through the pipeline are friction and elevation. Thus, using Newton's Laws of Motion, the velocity and acceleration of the pig is governed by the following equations:

$$M \cdot a = -F_{friction} + F_{pressure_drop} \pm F_{elevation} \quad V = V_o + at$$

where

M=Mass of smart pig a=acceleration of smart pig $F_{friction}$=Frictional force as a result of smart pig-to-pipeline interaction $F_{pressure_drop}$=Force acting on smart pig as a result of fluid passing over and through the smart pig $F_{elevation}$=Gravitational force acting on the smart pig in reference to a predetermined neutral plane.

V=velocity of smart pig $V_o$=previous velocity state of smart pig t=elapsed time between previous and present states From these equations, it may be seen that the velocity of the pig is determined by the frictional force, pressure drop and inclination/elevation of the pipeline. To permit the pig to operate at the low speeds necessary for effective MFL measurements, which is below 7 mph, the parameter easiest to control is the pressure drop across the pig. This is achieved by bypassing the majority of the gas through the pig, which in turn requires minimizing the pressure drop through the pig. In accordance with the invention, this is achieved by the use of a plurality of venturi-shaped passages through which fluid passing through the pig is introduced. This has been found to provide an accurate and simple mechanism for controlling pressure drop, particularly when the fluid is gas.

Specifically with methane gas at 714.5 psi operating pressure and a temperature of 25 C the maximum gas speed would be 11 mph with the maximum speed of the pig being at 7 mph, with conventional structures. Under these identical conditions, using a venturi-shaped passage in accordance with the invention, gas speeds to 20 mph maybe encountered while maintaining the pig speed at 7 mph maximum.

In accordance with the invention there is provided a variable speed pig for movement within a pipeline that has a cylindrical housing with an annular seal circumferentially mounted to the housing for sealing engagement between it and the pipeline. A plurality of venturi-shaped through passages extend longitudinally within the housing to receive flow passing through said pig. Means are provided for varying the size and shape of the passages to vary the pressure drop through the passages and pig to correspondingly vary the speed of the pig through the pipeline.

Each of the passages may have a tapered portion to recover a portion of pressure loss after said pressure drop through said through passage.

The passages each have a plurality of restrictions shaped to define a venturi opening within each of the passages.

In one embodiment of the invention, the through passages are disposed within the housing in spaced-apart circumferential relationship.

One embodiment for varying the size and shape of the passages includes a rotatable component.

Another embodiment for varying the size and shape of the passages, includes a component having selectively restricted portions and open portions for selective engagement with the passages to block portions of these passages to vary the size thereof.

The component and the passages may be mounted for relative movement.

The means for providing relative movement of the component and passages may be contained within the housing of the pig.

An embodiment of the invention provides that the component and the passages are axially mounted for relative movement.

In another embodiment of the invention, the size and shape of the openings through the passages may be varied by the use of a plurality of axially movable components. These axially movable components may be used with a plurality of fixed components, with the axially movable components being mounted for axial movement relative to the plurality of fixed components.

In yet another embodiment of the invention for varying the size and shape of the openings through the passages, a plurality of spaced-apart fixed components may be used that contain therein a component for selectively increasing and decreasing a portion of the fixed components for selective engagement and disengagement to vary the size of the openings through the passages. The component contained within the fixed components may be a rotatable interior component mounted within the fixed components for rotation between an axial position relative to the longitudinal axis of the fixed components and a position normal to this axis at which in this later position the rotatable interior component increases a portion of the fixed component.

Various supplemental means may be provided for varying friction between the pig and the pipeline to additionally vary the speed of the pig through the pipeline.

DETAILED DESCRIPTION OF THE PREFERRED EMBODIMENTS

Figure 1:
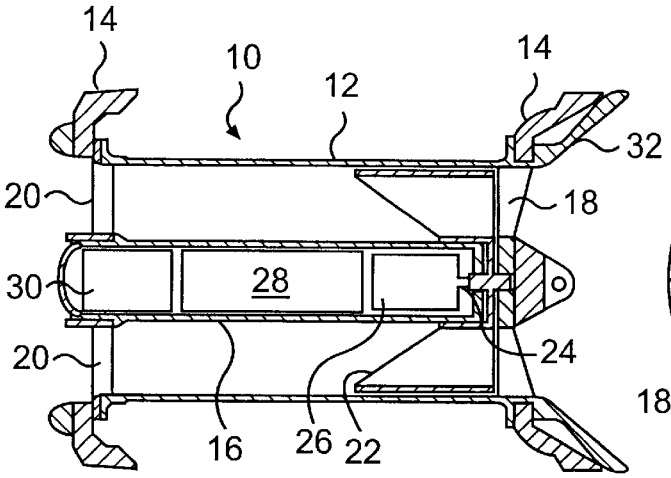
FIG. 1 is a view in vertical cross section of one embodiment of a pig in accordance with the invention.
Figure 1A:
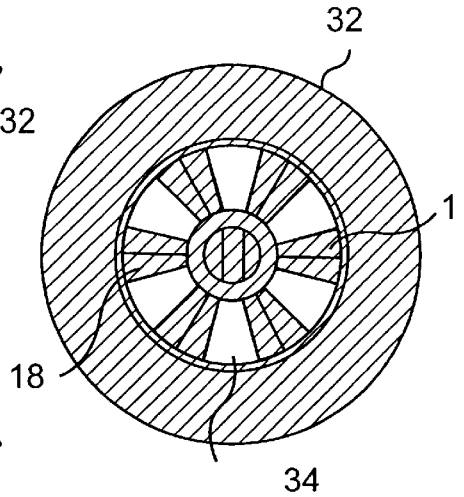
FIG. 1*a* is an end view of the inlet to the venturi passages of the pig of FIG. 1.

Referring to the drawings, and for the present to FIG. 1 thereof, there is shown a pig, designated generally as 10. The pig 10 has a cylindrical housing 12 which is supported by two annular gaskets 14 that provide sealing between the pipe interior and the pig.

An inner housing 16 is axially supported within the housing 12 by nozzle 18 and support bars 20.

A diffuser 22 is mounted within the housing 12 and adjacent nozzle 18. The diffuser 22 is connected to the shaft 24 of motor 26. Motor 26 is powered by basters 28 and controlled by electronic controller 30, thus providing means for moving the diffuser 22 relative to nozzle 18.

Flow through the pipe is in the direction of the arrow in FIG. 1. This flow is deflected by guide 32 through the nozzle 18 and then through diffuser 22.

Figure 2:
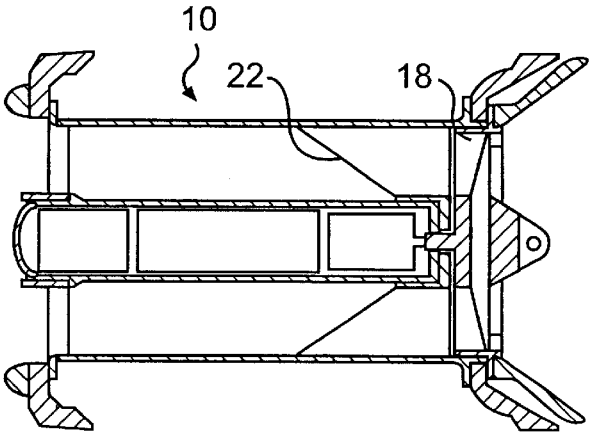
FIG. 2 is a sectional view similar to FIG. 1 of an additional embodiment of the invention.
Figure 2A:
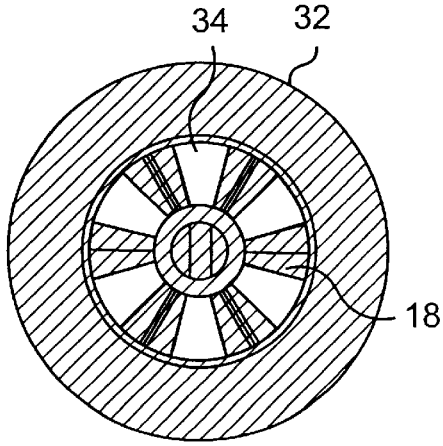
FIG. 2*a* is an end view of the inlet to the venturi passage of the pig of FIG. 2.
Figure 3A:
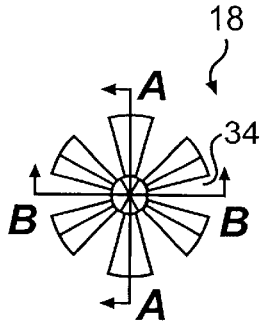
FIG. 3 is a showing of the venturi passages of FIG. 1, in the full open position with FIG. 3*a* being an end view, FIG. 3*b* being a sectional view taken along lines A—A of FIG. 3*a*, FIG. 3*c* being a sectional view taken along lines B—B of FIG. 3*a* and FIG. 3*d* being a perspective view of the venturi passages in the open position.
Figure 3B:
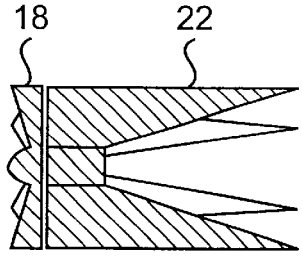
Figure 3C:
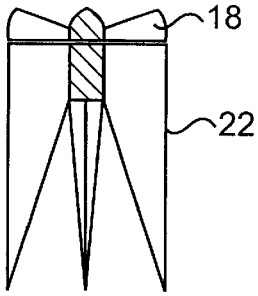
Figure 3D:
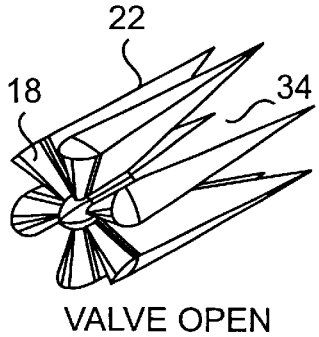
Figure 4A:
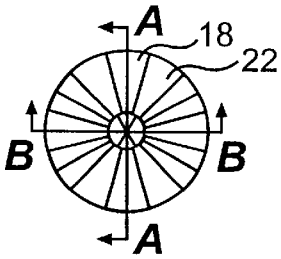
FIG. 4 is identical to FIG. 3, except that the venturi passages are in the fully closed position.
Figure 4B:
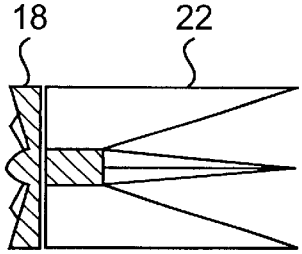
Figure 4C:
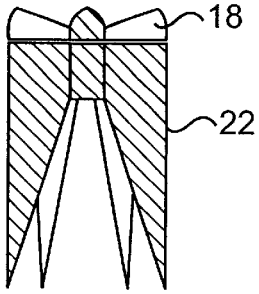
Figure 4D:
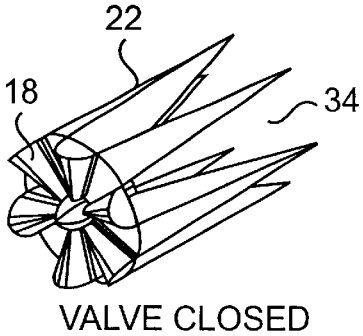

The embodiment of FIG. 2, differs from that of FIG. 1 in that diffuser 22 is stationary and the nozzle 18 is connected to shaft 24 and thus moves relative to the diffuser 22.

The function of the embodiments of FIGS. 1 and 2 may be best described and understood by reference to FIGS. 3 and 4.

As may be seen in FIGS. 3 and 4, the plurality of venturi passages 34 are formed by the nozzle 18 and diffuser 22. By the operation of motor 26 causing either rotation of diffuser 22 in the embodiment of FIG. 1 or the rotation of the nozzle 18 of FIG. 2, the venturi passages 34 may be moved to any selected extent from full open to being closed. In this manner, the pressure loss through the pig may be regulated to in turn, regulate the speed of the pig.

The use of this venturi structure provides an efficient mechanism for changing the flow through the pig, because it avoids turbulence and loss of momentum, and thus recovers static pressure rather than merely creating flow pressure loss, as is the case with prior art devices. Also, the use of this venturi structure in accordance with the invention greatly reduces product flow loss through the pipeline when the venturi passages are in the full open position.

In addition, this venturi structure provides for full closure thereof. This is important as a safety feature should the pig become stuck within a pipeline.

Figure 5:
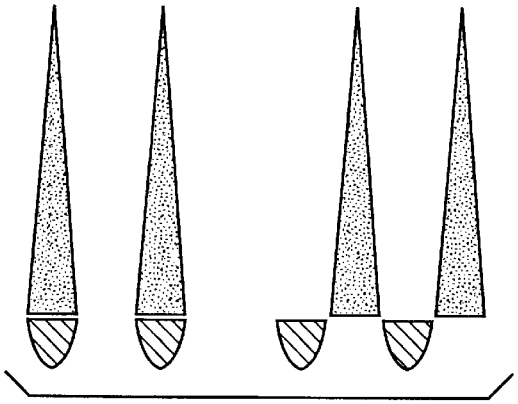
FIGS. 5, 6 and 7 are schematic showings of a venturi passage structure having multiple rotating components in the full open and closed positions.
Figure 6:
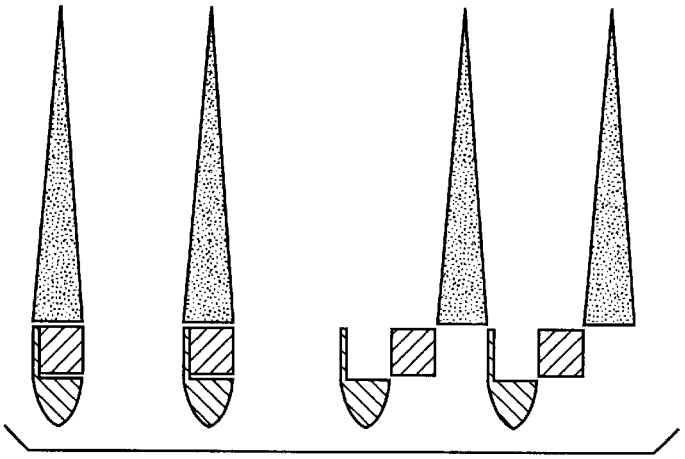
Figure 7:
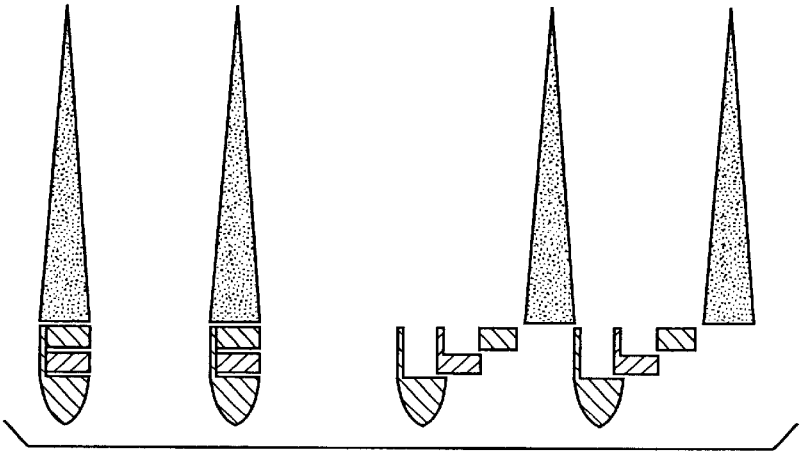

FIGS. 5, 6 and 7 are schematic showings of radial sections of an alternate embodiment of the invention that increases the opening of the venturi passage when in the full-open position. The venturi structure earlier shown and described herein is limited to no more than 50% opening of the venturi structure when in the full-opened position. This results from the vane-occupied annulus of the venturi passage having one static part and rotating part that must fully eclipse the open area. This structure is shown in FIG. 5. By using one static part and two rotating components in the form of vane-shapes, as shown in FIG. 6, the theoretical maximum opening could be increased to 66%. If one static component and three rotating segments are used, as shown in FIG. 7, the opening may be increased to 75%.

Figure 8A:
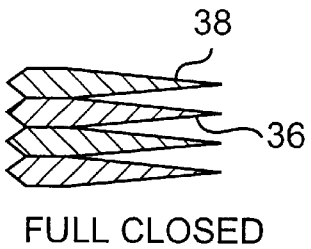
FIGS. 8*a*, 8*b* and 8*c* are schematic showings of the venturi passage structure of FIG. 8 in a fully closed position, an open position, and a fully open position, respectively.
Figure 8B:
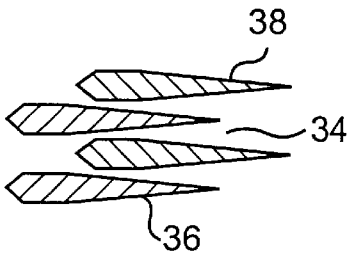
Figure 8C:
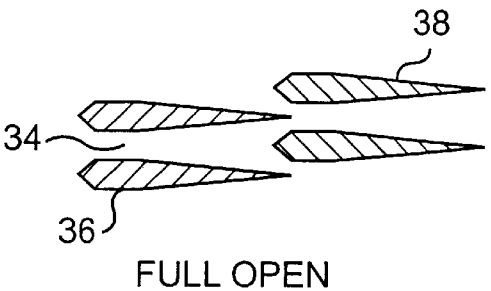
Figure 8:
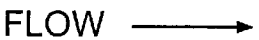
FIG. 8 is a perspective view of a venturi passage structure of an embodiment of the invention having axially movable components.
Figure 8:
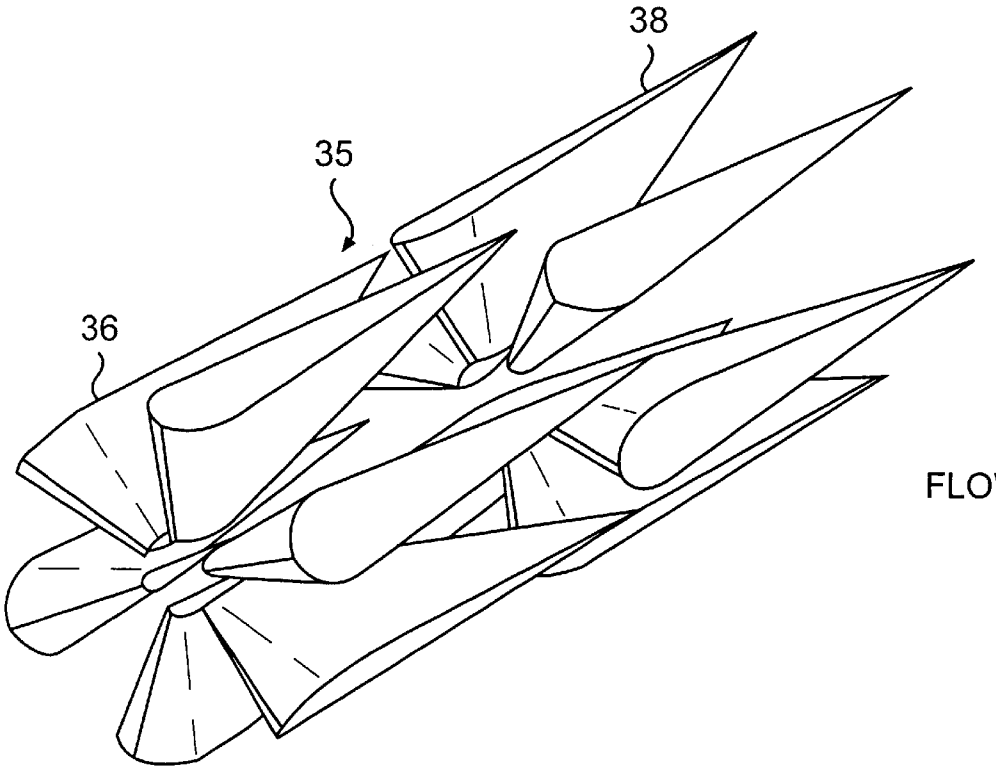

With respect to the embodiment of the invention shown in FIG. 8, a venturi structure designated generally as 35 includes fixed components 36 and movable components 38. As shown in FIGS. 8*a*, 8*b* and 8*c*, when the movable components 38 are moved axially toward the direction of flow through the venturi structure, as indicated by the arrow, thus varying the venturi passages 34. The venturi structure is in the fully closed position shown in FIG. 8*a*. Movement of the components 38 axially in the direction of flow opens the venturi structure, as shown in FIG. 8*b*. Further movement in this direction results in the venturi structure being in the fully open position as shown in FIG. 8*c*.

Figure 9A:
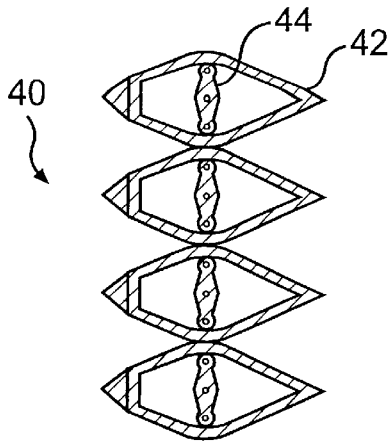
FIGS. 9*a*, 9*b* and 9*c* are schematic showings of a venturi passage structure of an additional embodiment of the invention in a fully closed position, an open position and a fully open position, respectively.
Figure 9B:
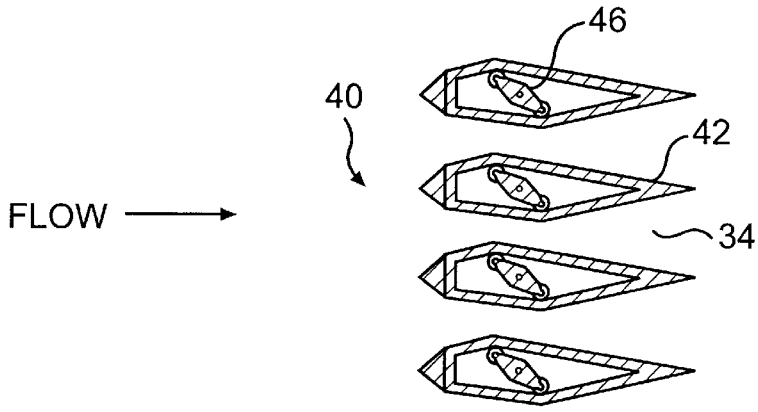
Figure 9C:
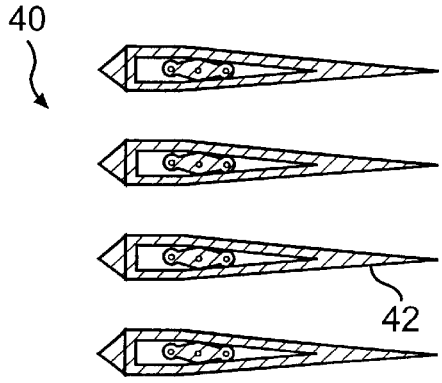
Figure 10A:
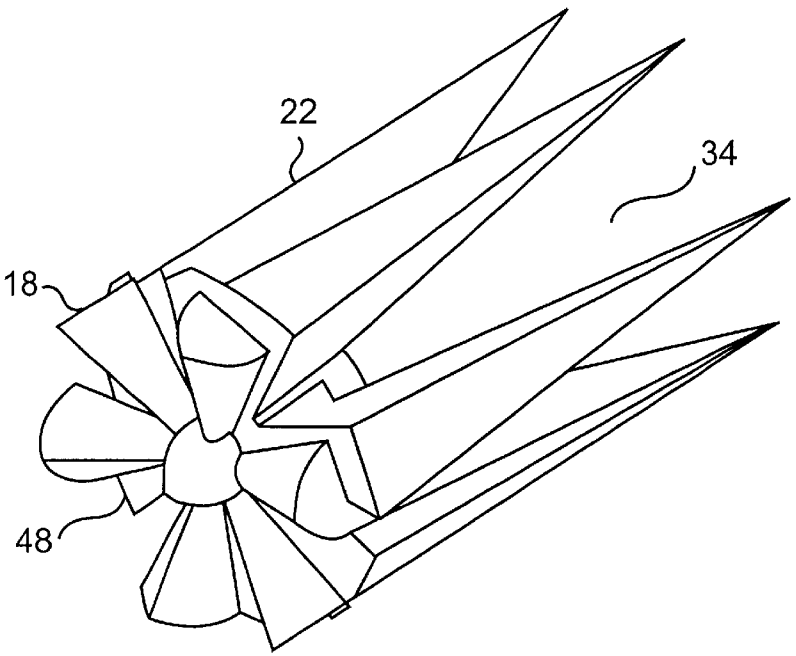
FIGS. 10*a*, 10*b*, 10*c* and 10*d* are schematic showings of a venturi structure of an additional embodiment of the invention where multiple stationary components are employed with one moveable component to vary the venturi passage.
Figure 10B:
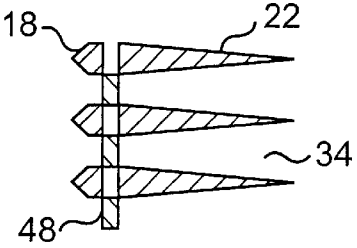
Figure 10C:
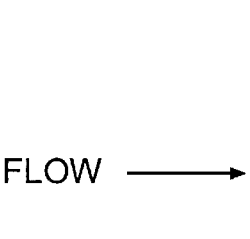
Figure 10D:
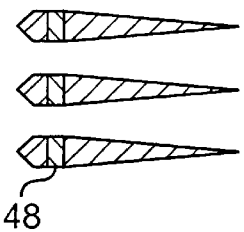

An additional embodiment of the invention is shown in FIGS. 9*a*, 9*b* and 9*c*. In this embodiment, a venturi structure, designated generally as 40, has a plurality of like fixed components 42 that are constructed of a resilient, expandable material, such as rubber. A rotatable component 44 is mounted for rotation about an axis 46 in each of the fixed components 42. When the rotatable component 44 is rotated on axis 46 to a position normal to the longitudinal axis of the fixed components 42, these components are expanded into contact with each other to fully close the venturi structure, as shown in FIG. 9*a*. As shown in FIG. 9*b*, when the rotatable components 44 are rotated toward the longitudinal axis of the fixed components 42, these fixed components are out of contact, thus opening the venturi structure. When the rotatable component is in the position in alignment with the longitudinal axis of the fixed components, as shown in FIG. 9*c*, the venturi structure is in the fully open position.

As shown in FIGS. 10*a* 10*b*, 10*c* and 10*d*, the nozzle 18 and diffuser 22 are stationary. The venturi passages are varied by a single component in the form of a plate 48 which could be attached to motor shaft 24 of FIG. 1. This plate is moved to vary the venturi passages 34 to regulate pressure loss, thus controlling the speed of the pig.

In combination with the venturi structure of the invention as shown and described herein, variation in friction may be used to adjust the mean velocity of the pig. This would allow the use of the same pig in high gas flow environments. In normal operation, the pipeline environment affects the kinetic friction exerted on the pig. The pipeline conditions that influence the kinetic friction are wall thickness changes, internal surface finish of the pipeline, and lubricity of the gas.

To adjust the operating range of the variable speed pig, the materials used in the construction of the annular gaskets 14 may be modified to affect friction. Increasing or decreasing the force applied in a direction normal to the pipe axis by the gaskets will vary in accordance with the relative stiffness of the gasket material to vary the friction.

The brushes used on the magnetizer to couple the magnetizer to the pipe wall could be varied to affect the friction.

The addition of brushes (or gasket material) elsewhere on the smart pig to adjust friction can be done also.

A motorized mechanism that is controlled by the same controller used for varying the venturi passages could be used to adjust the contact of the gasket or brush material with the inner pipe surface. This could be done to increase or decrease the friction. This mechanism could be placed anywhere on the smart pig. For example, there may be four such devices equally spaced circumferentially around one of the modules within the smart pig.

In accordance with conventional practice, the pig of the invention may be used to pull other modules through the pipeline.

The venturi may be placed at any position within the cylindrical housing of the pig.

Sensors may be used in conjunction with the pig to determine various factors such as pig speed, acceleration, pressure drop and inclination as a means to control the venturi passages.

What is claimed is:

1. A variable speed pig for movement within a pipeline comprising:

a cylindrical housing;

an annular seal circumferentially mounted to said housing for sealing engagement between said pipeline and said housing;

a plurality of venturi-shaped passages extending longitudinally within said housing to receive fluid flow passing through said pig;

means for varying size and shape of said passages to vary fluid pressure drop through said passages and said pig to correspondingly vary speed of the pig through said pipeline.

2. The variable speed pig of claim 1, wherein each of said passages has a tapered portion to recover a portion of pressure loss after said pressure drop through said through passages.

3. The variable speed pig of claim 1, wherein said passages each have a plurality of restrictions shaped to define a venturi opening within each of said passages.

4. The variable speed pig of claim 1, wherein said through passages are disposed in spaced apart, circumferential relation within said housing.

5. The variable speed pig of claim 1, wherein said means for varying said size and shape of said passages includes a rotatable component.

6. The variable speed pig of claim 5, wherein said means for varying said size and shape of said passages includes said component having selectively restricted portions and open portions for selective engagement with said passages to block portions of said passages to vary said size and shape thereof.

7. The variable speed pig of claim 6, wherein said component and said passages are mounted for relative movement.

8. The variable speed pig of claim 7, wherein means for said relative movement of said component and said passages are contained within said housing.

9. The variable speed pig of claim 8, wherein said component and said passages are axially mounted for said relative movement.

10. The variable speed pig of claim 1, wherein said means for varying said size and shape of said passages includes a plurality of axially movable components.

11. The variable speed pig of claim 10, wherein said means for varying said size and shape of said openings through said passages further includes a plurality of fixed components with said axially movable components being mounted for axial movement relative to said plurality of said fixed components.

12. The variable speed pig of claim 1, wherein said means for varying said size and shape of said passages includes a plurality of spaced-apart fixed components containing therein means for selectively increasing and decreasing a portion of said fixed components for selective engagement and disengagement to vary said size of said passages.

13. The variable speed pig of claim 12, wherein said means for selectively increasing and decreasing said portion of said fixed components includes a rotatable interior component mounted within said fixed components for rotation between an axial position relative to a longitudinal axis of said fixed components and a position normal to said longitudinal axis of said fixed components at which said rotatable interior component increases said portion.

* * * * *